United States Patent [19]

Lacey

[11] 4,342,140

[45] Aug. 3, 1982

[54] RESILIENT FASTENER HAVING KEEPER WITH LOCK

[75] Inventor: Robert L. Lacey, Palatine, Ill.

[73] Assignee: Illinois Tool Works Inc., Chicago, Ill.

[21] Appl. No.: 202,558

[22] Filed: Oct. 31, 1980

[51] Int. Cl.[3] ..... A45F 5/02

[52] U.S. Cl. ..... 24/373; 224/252

[58] Field of Search ..... 24/373, 375, 376, 3 K, 24/3 J, 3 L, 3 G, 3 F, 305; 224/252, 253, 268, 269

[56] References Cited

U.S. PATENT DOCUMENTS

| | | | |
|---|---|---|---|
| 1,377,724 | 5/1921 | Pavlik, Jr. | 24/3 K |
| 3,809,371 | 5/1974 | Martini | 24/373 |
| 4,113,156 | 9/1978 | Brito | 224/268 |
| 4,172,543 | 10/1979 | Fischer | 224/268 |
| 4,214,686 | 7/1980 | Dostourian | 224/269 |

*Primary Examiner*—Paul J. Hirsch

*Attorney, Agent, or Firm*—Jerold M. Forsberg; Thomas W. Buckman; Jack R. Halvorsen

[57] ABSTRACT

A one piece resilient sheet material fastener for retaining two or more elongated members in juxtaposed relation. The fastener includes a keeper and a locking means which requires the simultaneous application of a plurality of forces originating from differing directions in order to unlock the keeper for purposes of opening the fastener.

12 Claims, 10 Drawing Figures

RESILIENT FASTENER HAVING KEEPER WITH LOCK

BACKGROUND OF THE INVENTION

This invention relates to a resilient fastener adapted to accept and retain one or more elongated members in confined relation. Such devices can be used in the area of attaching a load carrying pouch to a belt worn around the waist of the user of the type used by hunters or the military. In the past an elongated generally oval shaped member has been provided with a portion of the oval removed to permit introduction of the belt or webbing of the pouch in juxtaposed relation. The device also includes an elongated slidable member for purposes of closing the opening through which the belt and/or web has been introduced. In such a keeper with slide the tip of the sliding member must enter a hole in the body of the keeper adjacent one extremity thereof. The tip of the sliding member is easily misaligned with the hole causing the sliding member to rest outside the hole and thereby permitting insecure attachment of the load carrying pouch resulting in possible loss of equipment. In addition, a force from only one direction is required to open the slide in such a keeper making it vulnerable to inadvertinent opening under rigorous conditions. Because the slide is actuated from one end (the top) and actually closes at the opposite end (the bottom end) the incorrect closure is easily overlooked by the user. Such a device because of its inherent nature has no design features to reduce the movement of the load along the supporting belt. The existing designs of such keepers with sliding lock members is a three piece assembly making it vulnerable to corrosion and dirt which compromises its reliability since the slide has no provision for positively retaining itself in a closed position other than friction, which can decrease with use. Further, because of the limited opening provided in one side of the elongated oval in such a member, it is difficult to insert a thick tough to bend belt to which it is attached.

SUMMARY OF THE INVENTION

The present invention relates to a fastener which shall be generally designated as a keeper with lock in which the procedure of attaching a load carrying pouch to a belt was simplified while providing a more positive and secure attachment than that which is known in the art. The present fastener or keeper with lock, has a locking member which automatically engages when the keeper is latched and requires a force from three different directions to reopen, thereby minimizing the opportunity of inadvertent opening.

The present keeper with lock actuates, closes and locks all at the same end of the fastener. Because of its spring resilient design, a tactile and audible indication of closure is provided. Also, because of the "spring member" design, if the keeper with lock is not fully closed it will return to its normally open position offering an obvious visual indication of non-closure.

Further this fastener is designed to place the belt and pouch attaching web in compression between its upper and lower portions to minimize load shifting along the belt.

An additional feature is a one piece design that offers advantages in terms of simplicity, reliability and weight thereby making it less vulnerable to the rigors of use and environment. Further advantages to the present device will be apparent when the drawings are read in conjunction with the detailed specification.

DETAILED SPECIFICATION

Figure 1:
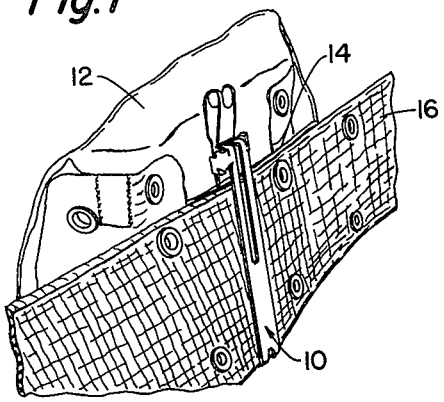
FIG. 1 is a perspective view of the environment in which the present invention is utilized.
Figure 2:
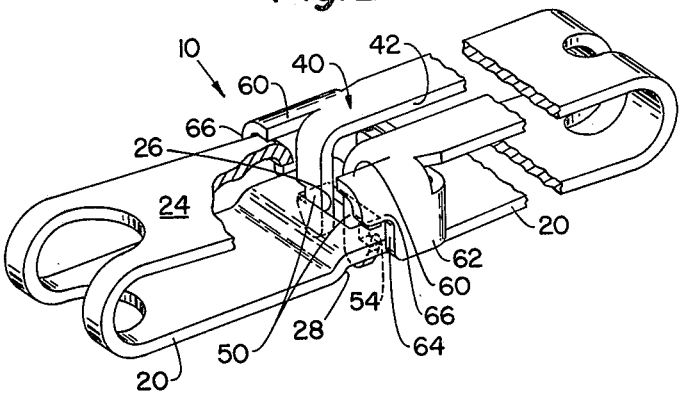
FIG. 2 is a perspective view in partial section of the device shown in FIG. 1.

Referring now to the drawings wherein similar parts are designated by similar numerals the fastener (10) of the present invention will be referred to herein as a fastener or alternatively as a keeper with lock, this later nomenclature being a term of the art for maintaining a load carrying pouch (12) and its associated web (14), fastened at both ends and free in the middle, in fixed relation to a supporting belt (16). The method of utilizing the fastener (10) and its operation will be described in more detail hereinafter.

The fastener (10) includes a base (20), which is the present instance is an elongated strip of sheet metal that is reversely bent upon itself at opposite ends by a retaining portion (22) and a locking portion (24). The base (20) includes an aperture (26) intermediate its ends, and in the present embodiment an elevated bridge portion (28), within the confines of which the aperture (26) is located for purposes best set forth hereinafter. Additionally the spring material forming the base (20) is provided with protuberant means (30) in the form of a bend line, as at point (30), which resiliently arches the base (20) towards the retaining portion (22), again for purposes best set forth hereinafter.

The retaining portion (22) is integrally connected to base (20) by the spring bend (32) forming one end of the fastener and with the spring portion (32) being relieved by slot means (34) for increasing the resiliency of the fastener. It will be appreciated that the length of the retaining portion (22) as well as its shape can be adjusted for the enviroment within which it is found, i.e., the present embodiment utilizes a web and belt combination whereas the invention also could be applicable to the confinement of wires or tubes. At the opposite or free end of retaining portion (22) is the keeper (40) serving the purpose of maintaining the retaining portion in a closed relation to the base (20). The retaining portion (22) is slotted for a substantial distance from its free end carrying the keeper (40) toward sthe resillent connection (32). The slot (42) forms a pair of arms (44) which are capable of movement towards one another as well as being capable of torsional bending or twisting about their juncture to the solid portion (46) of the retaining portion (22). At the free extremity of the arms

(44) there are provided a pair of legs (50) that extend generally perpendicularly to the arms (44). The legs (50) include a cammed lead in surface (52) and locking shoulder means (54), which in the present embodiment are proved by the notch (56). The notch (56) and its resultant shoulder (54) are designed to be accepted within the aperture (26), which in this embodiment is generally rectangular although its specific configuration is a matter of choice. The keeper (40) also includes axially extending flanges (60) and downwardly extending flange elements (62), the latter being relieved as at (64) to provide a short flange element (66) for purposes best set forth hereinafter.

Figure 4:
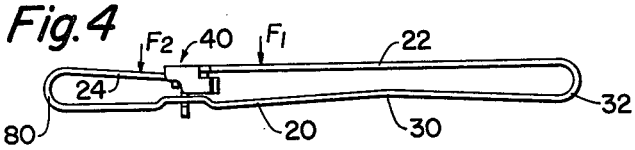
FIG. 4 is a side elevation showing the present invention in its closed mode.

To insure simultaneous movement of the arms (44) in the operation of this fastener a pair of actuating elements (70) are provided by extending the flanges (62) and thence being bent angularly inwardly from each arm (44) to underlie the adjacent arm (44). Therefore actuation by pressure along the direction of arrow F 1 (as seen in FIG. 4) forces the arms (44) towards the base portion (20). Even if only one arm is acted upon the underlying beamlike element (70) is contacted by the secondary arm and uniform movement of the retaining portion (22) with its independent arms (44) is accomplished.

Figure 3:
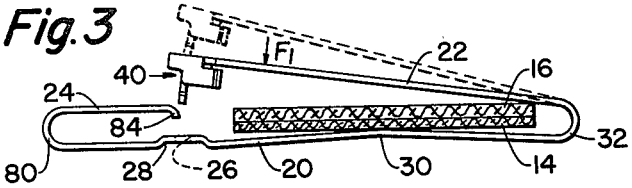
FIG. 3 is a side elevation showing the present invention in its open position.
Figure 6:
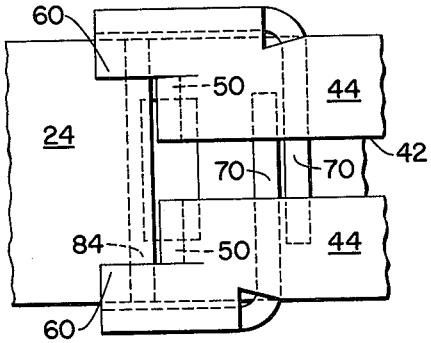
FIG. 6 is an enlarged fragmentary top view of the keeper and lock shown in FIG. 5.

At the opposite end of base (20) is a reversely bent connecting means (80) which also can be relieved by a slot (82) for purposes of increasing the resiliency of the overlying locking portion (24). The length of locking portion (24) which is provided with a curved free end (84) is chosen so as to be capable of underlying the extensions (60) of each arm (44). The width of locking portion (24) is such that it will be accomodated within the flange elements (62) and the small flange elements (66). Because of the resilient nature of the fastener the locking portion (24) can be moved downwardly towards the base portion (20) and its bridged section (28). The retaining portion (22) being resiliently connected at (32) to the base portion (20) can be sprung open, as best seen in phantom in FIG. 3, to thereby permit insertion of the work pieces being retained, namely the web (14) and the belt (16) in overlying juxtaposed relation. A force F 1, as seen in FIGS. 3 and 4, is applied to the retaining position (22) and its arms (44) to cause the keeper (40) to move in the direction of the aperture (26) so that it can be latched in a closed position. When the cam surfaces (52) of legs (50) contact the margins of aperture (26) it can be seen that the legs (50) will cause the arms (44) to torsionally twist, as best seen in FIG. 8B, until such time as the shoulders (54) pass the underside of the aperture (26) and bridging portion (28) to thereby latch the fastener in locked position, as best seen in FIG. 8C. As this occurs, the locking portion (24) and its curved end (84) are moved into a compressed spring relationship from the upper phantom position to the intermediate solid position shown in FIG. 7. This places a positive strain in keeping the shoulders (54) engaged with the underside of the bridge portion (28) and thereby insures positive locking which is accomplished with a tactile and audible indication of closure. If the shoulders (54) cannot reach a locked position the spring portion (32) will cause the retaining portion (22) to move to an open position which also insures an obvious visual indication of nonclosure. The positionment of the locking portion (24) and its curved end (84) between the downwardly extending flange elements (66) prevents the legs (50) from moving toward one another an adequate amount to disengage the shoulders (54) from the locked position.

Figure 5:
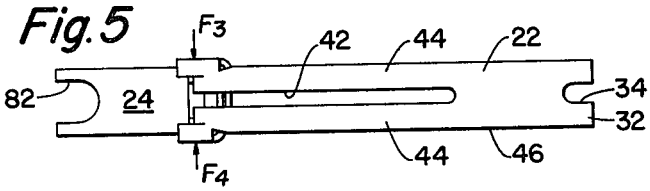
FIG. 5 is a top view of the device shown in FIG. 4.
Figure 7:
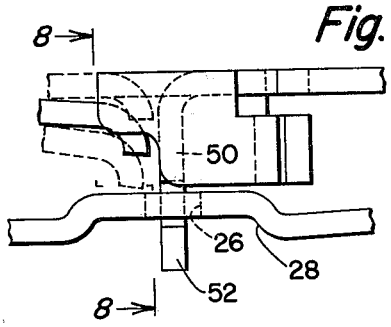
FIG. 7 is an enlarged side elevation of the device shown in FIG. 6 with the locking portion being shown in the locked position and with the open position and unlocking positions being shown in phantom.
Figure 8A:
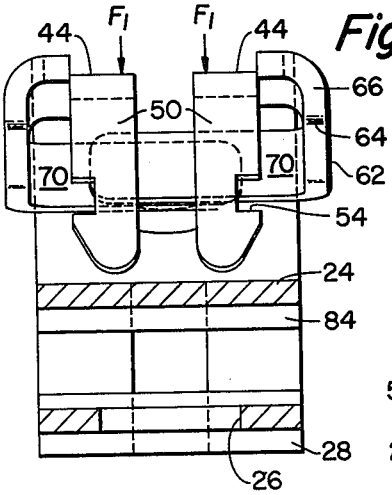
FIGS. 8A, 8B and 8C are sectional views taken along line 8 of FIG. 7 and respectively showing the open, locking and locked positions of the locking portion that are illustrated in phantom in FIG. 7.
Figure 8B:
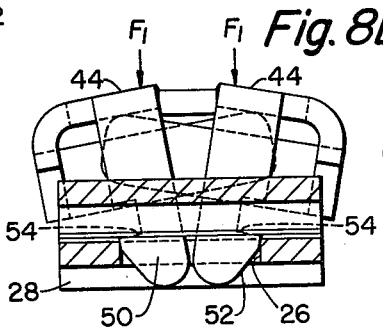
Figure 8C:
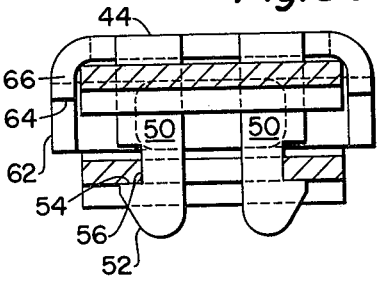

To unlock the fastener it is necessary to simultaneously apply three directions of force, as best seen in FIGS. 4 and 5, it is necessary to apply a force F 2 to the locking portion (24) so that it with its curved end (84) assumes the position shown in the lower phantom of FIG. 7, and in this lower position clears the extension (66) to thereby permit application of forces F 3 and F 4 against flange elements (62) to move the legs (50) toward one another and thereby disengage the shoulders (54) from their locked position. When shoulders (54) have been cleared to the center of aperture (26) the spring portion (32) of retaining portion (22) will automatically cause the fastener to open to permit removal or adjustment of the web or belt relative to its retained position.

As was previously indicated, the base portion (20) is bent in a spring loaded fashion, as at point (30), to close up the gap between itself and retaining portion (22) in the closed position. In this fashion a constant spring pressure is applied to the web (14) and belt (16) when they are positioned within the fastener. In actual practice base (20) generally assumes a substantially planer configuration with the web (14) and belt (16) being under compression.

While a single embodiment of the present invention has been disclosed it is considered that the configuration of base (20) and retaining portion (22) can be varied to accept other elements as opposed to flat belt like members, i.e., cables or tubular members, and still function as a retaining fastener. The present embodiment has been formed from heat treatable steel or other metals to provide the necessary resiliency. It should be recognized, however, that other embodiments of the invention could be constructed from other materials such as resilient plastics that would exhibit the necessary resilient characteristics without departing from the scope or spirit of this invention.

I claim:

1. A resilient fastener adapted to accept and retain one or more elongated members in confined relation including an elongated base portion having aperture means intermediate its extremities, a first-retaining portion overlying said base portion and resiliently connected to said base portion adjacent one end thereof to accept said one or more elongated members, keeper means adapted to cooperate with an acceptable within said aperture means in said base portion, said keeper means carried by said first retaining portion at its second end opposite the one end connected to said base portion, spring means for actuation of said keeper means, a second locking portion overlying said base portion and resiliently connected to said base portion at its second end opposite said one end with the free end of said second locking portion lying in opposition to said keeper means, said free end and said keeper means including cooperative locking means whereby engagement of said keeper means with said aperture means activates said locking means which prevents unintentional disengagement of said keeper from said base portion aperture means.

2. A fastener of the type contemplated in claim 1 wherein said spring means includes an axially disposed central slot formed in said first retaining portion and extending through a substantial extent thereof from said keeper means toward its connection to said base portion to thereby provide a pair of resilient arms capable of both lateral shifting as well as torsional twisting.

3. A fastener of the type claimed in claim 2 wherein said keeper includes a pair of shouldered legs, one of said legs extending angularly from the free end of each of said arms and capable of movement relative to one another by lateral or torsional movement of said arms.

4. A fastener of the type claimed in claim 3 wherein said keeper means includes flange means carried by said arms and extending axially beyond the juncture of said arms and legs, said flanges including elements extending downwardly toward said base portion along the outboard longitudinally disposed edges of said arms, said flange means adapted to override the free end of said second locking portion while said flange elements contact the opposite edges of said second locking portion to prevent lateral movement of said arms toward each other and which would thereby unlock said legs from said base portion aperture means.

5. A fastener of the type claimed in claim 4 wherein said flange elements include a relieved section whereby spring depression of said locking portion towards said base portion aligns said locking portion with said relieved section and permits movement of said arms towards each other to permit disengagement of said shoulders of said legs from said base portion aperture means and thereby permit opening of at least said retaining portion to permit insertion or removal of at least one of said elongated members.

6. A fastener of the type claimed in claim 3 wherein actuating means are located adjacent said keeper means, said actuating means permitting lateral and torsional movement of said arms relative to one another but which only permits substantially unified movement of said arms toward and away from said base portion thereby insuring positive movement of said legs into engagement even if only one arm is acted upon.

7. A fastener of the type claimed in claim 6 wherein said actuating means includes beam-like means carried by each arm which underlies the adjacent arm in close proximity thereto.

8. A fastener of the type claimed in claim 7 wherein each of said flange elements include an extension that is bent angularly relative thereto and has a length sufficient to underlie the other arm and serve as said actuating means.

9. A fastener of the type claimed in claim 1 wherein said base portion is provided with spring means intermediate its aperture and its connection to said retaining portion for insuring pressure on said members when they are in captured position.

10. A fastener of the type claimed in claim 9 wherein said base portion is deformed out of its plane in the direction of said overlying first retaining portion to resiliently impinge on said members.

11. A fastener of the type claimed in claim 1 wherein the connections of said first and second portions to said base portion are relieved to increase their resilience.

12. A fastener of the type claimed in claim 3 wherein said base portion is arched toward said first and second portions in the region of said aperture whereby when said legs are in their engaged position they have little or no projection beyond the plane of said base portion.

* * * * *